United States Patent [19]

Prestidge

[11] Patent Number: 4,594,818

[45] Date of Patent: Jun. 17, 1986

[54] APPARATUS FOR ATTACHING FLASHING TO A ROOF

[76] Inventor: Pat A. Prestidge, 641 Illinois Ave., Elgin, Ill. 60120

[21] Appl. No.: 730,210

[22] Filed: May 3, 1985

[51] Int. Cl.[4] ..... E04D 1/36
[52] U.S. Cl. ..... 52/58
[58] Field of Search ..... 52/58-62, 52/273, 200

[56] References Cited

U.S. PATENT DOCUMENTS 1,705,160 3/1929 Stagg ..... 52/58
2,851,973 9/1958 Stark ..... 52/200

FOREIGN PATENT DOCUMENTS 2060292 6/1972 Fed. Rep. of Germany ..... 52/60

*Primary Examiner*—John E. Murtagh
*Attorney, Agent, or Firm*—Mathew R. P. Perrone, Jr.

[57] ABSTRACT

In the roofing industry, a flashing attachment simplifies a roofing project by use of the flashing attachment including a flashing support with a plurality of pieces of flashing attached to the flashing support.

17 Claims, 3 Drawing Figures

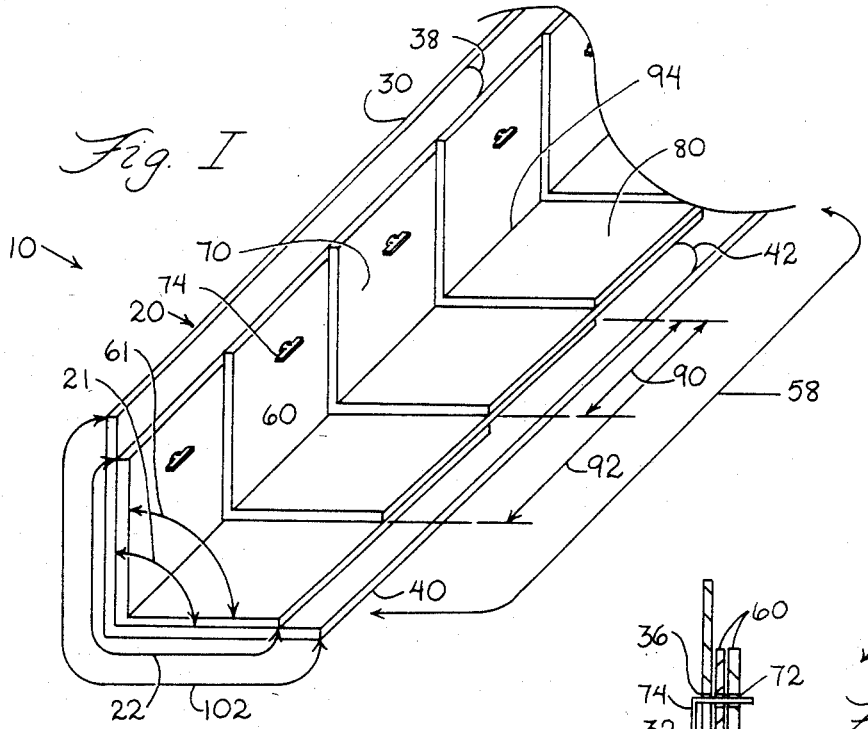
Fig. I
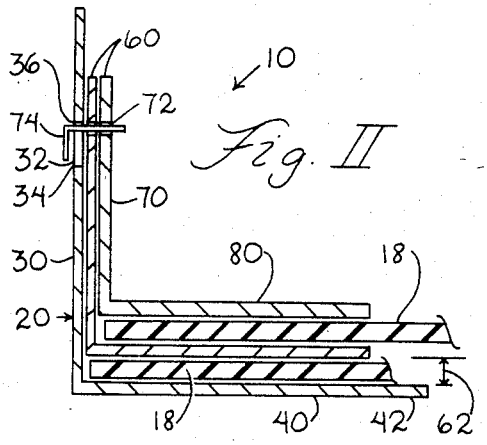
Fig. II
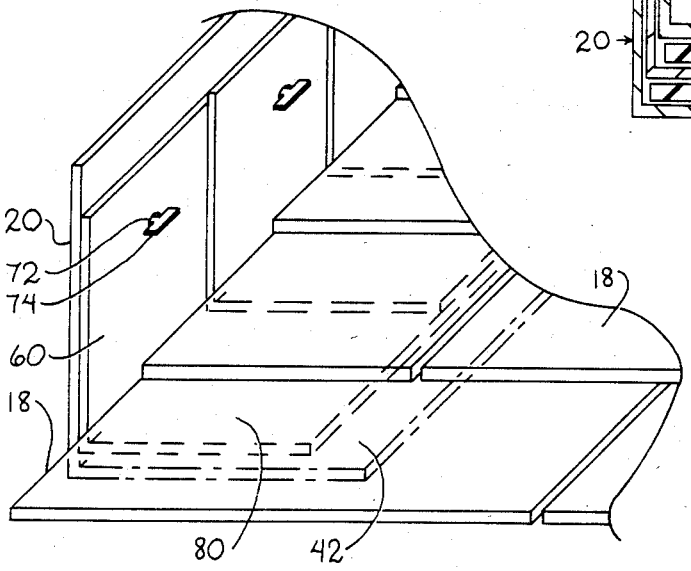
Fig. III

APPARATUS FOR ATTACHING FLASHING TO A ROOF

BACKGROUND OF THE INVENTION

This invention relates to the roofing industry and more particularly to a method and apparatus for securing flashing to a roof.

Flashing, when used in roofing, is designed to manipulate the flow of water in a certain direction on the roof. Flashing also protects sections of a building where the roofing material abuts a wall or an edge. Commonly, flashing is used adjacent house chimneys. Flashing is also used when the building has more than one roof level. For example, a garage has a roof lower than the roof of a two story house. Flashing is needed where the shingles abut the house to prevent leakage between the wall of the house and the roof of the garage.

Customarily, flashing is attached to the house one piece at a time. It is difficult for a roofer to hold the flashing and the shingles in place and achieve the desired security for the positioning of these elements. Furthermore, due to the variety of thickness of shingles, and the variety of types of materials which are used for shingles, it is difficult to simplify the attaching of flashing material during a roofing project.

The desirability of simplifying the flashing attachment to a roof, thus, becomes clear. The problems in the art are so great, that improvement in this field is clearly needed.

SUMMARY OF THE INVENTION

Therefore, it is an object of this invention to provide a method for simplifying the attachment of flashing to a roof.

A further object of this invention is to provide an apparatus for simplifying the attachment of flashing to a roof.

A still further object of this invention is to provide a method for simplifying roofing and flashing attachments.

A still further object of this invention is to provide a method for holding roofing and flashing for attachment to a roof.

Also an object of this invention is to provide an apparatus for holding roofing and flashing while attaching roofing and flashing to a roof.

These and other objects (which other objects become clear by considering the specification, claims and drawing Figures as a whole) are met by providing a flashing support of an elongated nature with flashing attached thereto.

BRIEF DESCRIPTION OF THE DRAWINGS

FIG. I is a perspective view of flashing attachment 10.

FIG. II is a end view, cross-section of FIG I.

FIG. III is a partial perspective view of flashing support 20 with pieces of flashing 60 secured thereto and roofing material 18 positioned therein.

Throughout the figures of the drawing where the same part appears in more than one figure of the drawing, the same number is applied thereto.

DESCRIPTION OF THE PREFERRED EMBODIMENTS

Flashing attachment in a roofing project is greatly simplified by use of the flashing attachment including a flashing support with a plurality of pieces of flashing attached to the flashing support.

Referring now to FIG. I, flashing attachment 10 is shown as including flashing support 20 and flashing 60. Flashing support 20 includes a wall flap 30 and a roof flap 40, with a flashing area 22 generally covered by flashing 60. Flashing support 20 has a wall flap 30 with a plurality of flap slots 32 therein. Slot bottom 34 of each flap slot 32 is a suitable distance from slot top 36 provide for flashing 60 to be adjusted into position and receive various thicknesses of roofing material 18 (shown in FIG. II).

Wall flap extension 38 of wall flap 30 extends beyond flashing area 22 and is used to secure flashing support 20 to a house wall (not shown). Roof flap 40 of flashing support 20 rests under the roofing material. Roof flap 40 includes a roof flap extension 42 extending beyond flashing area 22. In this matter, flashing support 20 may be nailed to the roof while the flashing 60 is held in position for roofing purposes.

When considering FIG. II and FIG. III, it becomes clear that flashing 60 is movable relative to flashing support 20 through flap slot 32, so that flashing space 62 can be created for inserting roofing material 18 into flashing space 62 between roof flap 40 and holding flap 80 of flashing 60. Roofing material 18 overlaps flashing 60 and other piece or pieces of roofing material 18 in standard fashion. Thus, holding flap 80 of flashing 60 is adjacent the roofing material 18. Base flap 70 of flashing 60 is adjacent wall flap 30 of flashing support. Base flap 70 includes a base aperture 72 so that a holder 74 may be inserted through base aperture 72 and into flap slot 32. In this fashion, with the holder 74 sliding up and down the flashing space 62, the flashing space 62 is adjusted.

In this fashion, attachment of flashing 60 and placing of roofing material 18 are greatly simplified. The flashing support 20 needs only to be attached to the roof by nails or other suitable material through roof flap 40. Roofing material 18 may then be inserted in flashing space 62 and secured therein. This is followed by securing wall flap 30 to the wall of the building under construction. By securing the roof flap 40 to the building first, flashing 60 is in position to hold the roofing material 18 on the roof.

Roofing material 18 overlaps flashing 60 and other piece or pieces of roofing material 18 in standard fashion. Thus, a piece of roofing material 18 is on top of one piece of flashing 60 and below the adjacent piece of flashing 60. This is the standard overlap procedure used in the roofing industry—especially with shingles.

Flashing 60 is a single piece of flashing. Flashing collection 58 is a plurality of flashing 60 secured to flashing support 20. These small pieces of flashing 60 are held into position due to holder 74 positioning the flashing on flashing support 20. The length of flashing support 20 permits the plurality of flashing pieces 60 in the form of flashing collection 58 to be secured to the roof at once. Generally speaking, flashing support 20 includes a support angle 21 between wall flap 30 and roof flap 40. This support angle 21 may be adjusted to fit the desired roof. However, support angle 21 is generally about ninety (90°) degrees. Flashing 60 has a flash angle 61 similar to support angle 21 between base flap 60 and holding flap 80.

Within flashing collection 58, each piece of flashing 60—as secured to flashing support 20—has an overlap 90 with an adjoining piece of flashing 60. Overlap 90 includes up to about seventy five (75%) percent of flashing width 92 as measured along flashing bend 94. More preferably, overlap 90 includes about thirty five (35%) to about seventy five (75%) percent of flashing width 92. Most preferably, overlap 90 includes about forty five (45%) to about fifty five (55%) percent of flashing width 92.

Flashing area 22 is related to flashing support area 102 flashing support 20 in a fashion similar to overlap 90. Flashing area 22 includes up to about seventy five (75%) percent of flashing support area 102. More preferably, flashing area 22 includes about thirty five (35%) to about seventy five (75%) percent of flashing support area 102. Most preferably, flashing area 22 includes about forty five (45%) to about fifty five (55%) percent of flashing support 102.

In operation, flashing attachment 10 with flashing support 20 and flashing 60 as flashing collection 58 are placed in position on the roof. Roof flap 40 of flashing support 20 is then nailed into position. Roofing material 18 is then inserted into flashing space 62 and secured to the roof. Flashing 60 is then pushed down on top of the roofing material 18 and secured by the roofer. The flashing support 20 and flashing 60 is then secured by nailing or other suitable means at base flap 70 and wall flap 30. In this fashion, an appropriate roof is achieved.

Because of the disclosure herein and solely because of the disclosure herein, certain modifications of the device disclosed and claimed herein can become apparent to those having ordinary skill in this art. Such modifications are clearly covered hereby.

What is claimed and sought to be secured by Letters Patent of the United States is:

1. A flashing attachment including a flashing support with a plurality of pieces of flashing secured thereto, wherein:

a. said flashing support further includes a wall flap and a roof flap;
b. said flashing support includes a flashing area partially covered by said flashing;
c. said wall flap includes a plurality of flap slots;
d. each of said flap slots include a slot bottom and a slot top;
e. said slot bottom and said slot top are oppositely disposed and spaced sufficiently to provide for said flashing to be adjusted into position and receive various thicknesses of roofing material;
f. said wall flap includes a wall flap extension extending beyond said flashing area;
g. said wall flap extension is used to secure said flashing support to a house wall;
h. said roof flap rests under roofing material; and
i. said roof flap includes a roof flap extension extending beyond said flashing area.

2. The flashing attachment of claim 1 wherein said flashing includes a base flap adjacent said wall flap and a holding flap adjacent said roof flap.

3. The flashing attachment of claim 2 wherein said flashing is movable relative to said flashing support to create flashing space between said roof flap and said holding flap.

4. The flashing attachment of claim 3 wherein said base flap includes a base aperture to receive a holder to be inserted through said base aperture and into said flap slot to thereby movably secure said flashing to said flashing support.

5. The flashing attachment of claim 4 wherein said flashing space receives said roofing material.

6. The flashing attachment of claim 5 wherein said flashing support is of sufficient length to permit a flashing collection to be secured thereto, said flashing collection comprising a plurality of said flashing.

7. The flashing attachment of claim 6 wherein said flashing support includes a support angle between said wall flap and said roof flap.

8. The flashing attachment of claim 7 wherein said support angle is adjusted to fit said roof.

9. The flashing attachment of claim 8 wherein said flashing has a flash angle similar to said support angle.

10. The flashing attachment of claim 9 wherein said flashing support includes a support angle between said wall flap and said roof flap.

11. The flashing attachment of claim 10 wherein said support angle is about ninety degrees.

12. The flashing attachment of claim 11 wherein said flashing collection has a piece of said flashing in overlapping relationship with an adjoining piece of said flashing.

13. The flashing attachment of claim 12 wherein said flashing has a flashing bend between said base flap adjacent and said holding flap.

14. The flashing attachment of claim 13 wherein said overlapping relationship includes up to about seventy five percent of a length of said flashing bend.

15. The flashing attachment of claim 14 wherein said overlapping relationship includes about thirty five to about seventy five percent.

16. The flashing attachment of claim 16 wherein said overlapping relationship includes forty five to about fifty five percent.

17. A flashing attachment including a flashing support with a plurality of pieces of flashing secured thereto, wherein:

a. said flashing support further includes a wall flap and a roof flap;
b. said flashing support includes a flashing area partially covered by said flashing;
c. a securing means for movably securing said plurality of pieces of flashing to said flashing support;
d. said wall flap includes a wall flap extension extending beyond said flashing area;
e. said wall flap extension is used to secure said flashing support to a house wall;
f. said roof flap rests under roofing material; and
g. said roof flap includes a roof flap extension extending beyond said flashing area.

* * * * *